US009038575B2

(12) United States Patent
Boros et al.

(10) Patent No.: US 9,038,575 B2
(45) Date of Patent: May 26, 2015

(54) PILOT BURNER SYSTEM FOR WATER HEATERS

(71) Applicant: Rheem Manufacturing Company, Atlanta, GA (US)

(72) Inventors: Jozef Boros, Montgomery, AL (US); Ashwin Rao, Montgomery, AL (US); Subbramanian Thenappan, Montgomery, AL (US); David L. Gibbons, Prattville, AL (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 297 days.

(21) Appl. No.: 13/647,651

(22) Filed: Oct. 9, 2012

(65) Prior Publication Data

US 2014/0096726 A1 Apr. 10, 2014

(51) Int. Cl.

| | |
|---|---|
| ***F24H 9/20*** | (2006.01) |
| ***F24H 1/28*** | (2006.01) |
| ***F24H 1/20*** | (2006.01) |
| ***F23D 14/70*** | (2006.01) |
| ***F23D 14/84*** | (2006.01) |

(52) U.S. Cl.

CPC ..... *F24H 1/206* (2013.01); *F24H 9/2035* (2013.01); *F23D 14/70* (2013.01); *F23D 14/84* (2013.01); *F23D 2900/00014* (2013.01); *F23D 2900/00015* (2013.01)

(58) Field of Classification Search

CPC ..... F23D 14/70; F23D 14/84; F23D 2900/00015; F23D 2900/00014; F24H 9/2035; F24H 1/206

USPC ..... 122/14.2, 18.1; 431/172, 177, 278, 281, 431/285

See application file for complete search history.

(56) References Cited

U.S. PATENT DOCUMENTS

| | | | | |
|---|---|---|---|---|
| 2,070,535 | A | 2/1937 | Hansen | |
| 2,446,941 | A * | 8/1948 | Woodward | 431/119 |
| 2,549,755 | A * | 4/1951 | Burwell | 122/183 |
| 3,580,224 | A * | 5/1971 | Rouet et al. | 122/18.31 |
| 3,695,811 | A * | 10/1972 | Brandt et al. | 431/43 |
| 4,161,214 | A | 7/1979 | Wendel | |
| 4,338,888 | A | 7/1982 | Gerstmann et al. | |
| 4,445,464 | A | 5/1984 | Gerstmann et al. | |
| 4,699,091 | A | 10/1987 | Waters | |
| 4,821,682 | A | 4/1989 | Waters | |
| 6,139,311 | A * | 10/2000 | Bowman et al. | 431/278 |
| 6,302,062 | B2 | 10/2001 | Overbey, Jr. et al. | |
| 6,554,608 | B1 | 4/2003 | Bowman et al. | |
| 6,684,821 | B2 | 2/2004 | Lannes et al. | |
| 2011/0048340 | A1 * | 3/2011 | Anderson et al. | 122/14.22 |

* cited by examiner

*Primary Examiner* — Steven B McAllister
*Assistant Examiner* — Steven Anderson, II
(74) *Attorney, Agent, or Firm* — Haynes and Boone, LLP

(57) ABSTRACT

A tube disposed in the combustion chamber of a standing pilot type fuel-fired water heater is used to increase the overall efficiency of the water heater by improving the heat transfer from the pilot flame to the tank during standby periods by funneling the standing pilot flame upwardly through the tube in a manner concentrating the pilot flame heat against an underside portion of the bottom head of the water heater tank. To further increase water heater efficiency, the pilot burner is of a dual input type. Various pilot burner operational algorithm modes are disclosed for causing the pilot burner to operate at a high firing rate during main burner operation, and at a low firing rate during standby periods.

26 Claims, 10 Drawing Sheets

PILOT BURNER SYSTEM FOR WATER HEATERS

BACKGROUND OF THE INVENTION

The present invention generally relates to fuel-fired liquid heating apparatus and, in a representatively illustrated embodiment thereof, more particularly provides a fuel-fired water heater having disposed in a combustion chamber portion thereof specially designed heat concentration apparatus operative to reduce standby heat losses and thereby improve overall efficiency of the water heater by concentrating the heat of a standing pilot flame on an underside portion of the bottom wall of the storage tank portion of the water heater. According to a further aspect of the invention, the overall efficiency of the water heater may also be increased by the use and a unique control of a dual input standing pilot burner.

In previously proposed fuel-fired water heater designs, the water heater has, within its combustion chamber, a pilot burner operative to maintain a standing pilot flame during "standby" periods of the water heater in which its main burner is not being fired. The heat from the standing pilot flame may simply escape through the vertical flue of the water heater without adding appreciable heat to water stored in the tank portion of the water which overlies the combustion chamber, or sometimes overheat the tank water during standby periods. From an operational standpoint, neither of these conditions is ideal.

It would accordingly be desirable to provide an improved water heater pilot burner system that addresses these conditions. It is to this goal that the present invention is primarily directed.

SUMMARY OF THE INVENTION

In carrying out principles of the present invention, in accordance with a representatively illustrated embodiment thereof, fuel-fired liquid heating apparatus is provided. Illustratively, the apparatus is a fuel-fired water heater having a tank for holding a quantity of water to be heated, the tank having a bottom wall or head portion. A combustion chamber is disposed beneath and upwardly bounded by the bottom wall, and a flue communicates with the combustion chamber, via an open lower end of the flue, and extends upwardly from the bottom tank wall through the interior of the tank. The water heater is provided with fuel-fired combustion apparatus operative to create within the combustion chamber hot combustion products which flow upwardly through the flue and transfer heat therethrough to water stored in the tank. The combustion apparatus representatively comprises a main fuel burner disposed within the combustion chamber in an underlying relationship with the open lower end of the flue, the main fuel burner having a peripheral, horizontally facing side edge.

Also forming a portion of the overall combustion apparatus is a specially designed pilot burner system which embodies principles of the present invention and representatively comprises a pilot fuel burner and a heat concentrating structure. The pilot fuel burner is disposed within the combustion chamber and is operative to create within the combustion chamber, during standby periods of the water heater, a standing pilot flame underlying a bottom surface portion of the bottom tank wall horizontally offset from the open bottom end of the flue. The heat concentrating structure is interposed between the pilot fuel burner and the bottom surface portion of the bottom tank wall, and has a generally vertical, open-ended passage extending therethrough and being operative to upwardly receive the standing pilot flame and concentrate its heat on the bottom surface portion of the bottom wall of the tank. In this manner, instead of merely passing upwardly through the flue, the heat of the standing pilot flame is more efficiently utilized to heat the tank water during standby periods of the water heater.

Preferably, the heat concentrating structure is a generally vertically oriented tube member downwardly offset from the bottom surface portion of the bottom tank wall. According to various aspects of the present invention, the tube member may illustratively have a downwardly and horizontally outwardly flared bottom end portion with a side cutout area extending upwardly the bottom end edge of the tube member and disposed in a facing, horizontally adjacent relationship with the main burner peripheral edge to facilitate pilot flame lighting of the main burner.

In a representatively illustrated alternate embodiment of the water heater, the main burner, the pilot burner and the tube member are carried on a section of a main burner fuel supply line which is inwardly insertable through a combustion chamber side wall opening to operatively position the main burner, pilot burner and tube member within the combustion chamber. The tube member is pivotally supported on the fuel supply line section for pivotal movement relative thereto between a generally horizontal installation orientation, facilitating passage of the tube member through the combustion chamber side wall opening, and a generally vertical orientation to which the tube member may be moved after it is positioned within the combustion chamber. A detent structure is preferably provided for releasably locking the inserted tube member in its generally vertical operating orientation within the combustion chamber.

According to a further aspect of the invention, which may be used in conjunction with or in place of the aforementioned heat concentrating structure, an improved standing pilot burner system is provided that increases the efficiency of a fuel-fired water heater in which it is incorporated. The standing pilot burner has dual firing rates—a high firing and a low firing rate. Four representative modes of controlling the dual firing rate pilot burner are provided. In all four modes, during periods that the main burner is operating in response to a demand for heat the pilot burner is set to its high firing rate, and when the main burner shuts off in response to satisfaction of the heat demand the pilot burner is set to its low firing rate.

In the first mode the pilot burner is maintained at its low firing rate during the entire standby period, and is returned to its high firing rate in response to the next heat demand. In the second mode, the pilot burner is reset from its high firing rate to its low firing rate at the onset of a standby period, but is returned to its high firing rate during portions of such standby period in which the sensed tank water temperature is less than the water heating set point temperature by a predetermined amount. In the third mode, the pilot burner is reset from its high firing rate to its low firing rate at the onset of a standby period, but is returned to its high firing rate during the standby period in response to a sensed predetermined rate of decrease in tank water temperature. In the fourth mode, the pilot burner is reset from its high firing rate to its low firing rate at the onset of a standby period, but is returned to its high firing rate during the standby period after being at its low firing rate for a predetermined time during such standby period.

DETAILED DESCRIPTION

Figure 1:
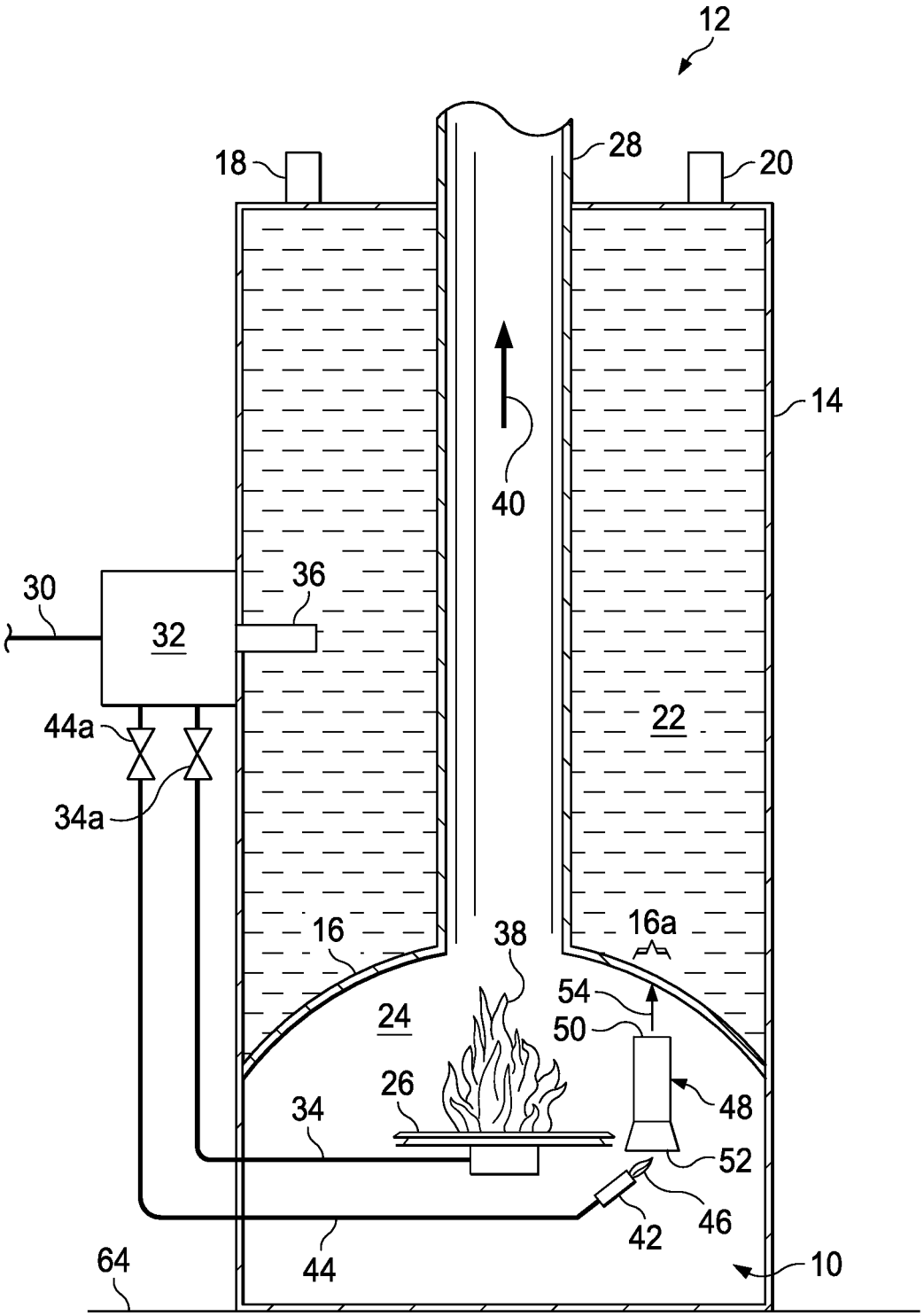
FIG. 1 is a schematic, horizontally directed cross-sectional view through a fuel-fired water heater incorporating therein a specially designed pilot burner system embodying principles of the present invention.

The present invention generally relates to better utilization of energy available to a fuel-fired water heater and, in a representative embodiment thereof provides an improved pilot burner system 10 for a fuel-fired liquid heating apparatus which is representatively a gas-fired water heater 12. Water heater 12 includes an insulated tank 14 having a bottom wall or head 16, a cold water inlet fitting 18 and a hot water outlet fitting 20. Tank 14 is adapted to hold a quantity of water 22 to be heated. The bottom head 16 overlies a combustion chamber 24 in which a main gas burner 26 is operatively disposed. Main gas burner 26, which, along with the pilot burner system 10, forms a part of a fuel-fired combustion apparatus portion of the water heater 12, underlies the open bottom end of a flue pipe 28 which communicates with the interior of the combustion chamber 24 and extends from the bottom head 16 upwardly through a central portion of the tank 14.

The main burner 26 is supplied with gas from a source thereof, such as a main supply line 30, via a conventional gas valve and control 32 coupled to the main burner 26 by a gas supply line 34 having a main gas valve 34*a* therein. Gas valve and control 32 senses the temperature of the water 22 in the tank 14 by means of a sensing element 36 extending into the tank interior. Firing of the main burner 26 creates a main burner flame 38 which, in turn, creates hot combustion gases 40 that flow upwardly through the flue 28 and transfer heat therethrough to the tank water 22.

Pilot system 10 is a standing pilot system including a pilot burner 42 disposed within the combustion chamber 24 adjacent the main burner 26 and supplied with gas via a supply line 44 interconnected between the pilot burner 42 and the gas valve and control 32 and having a pilot gas valve 44*a* therein. During "standby" periods of the water heater 12 (i.e., periods when the main burner 26 is not being fired), the pilot burner 42 continues to generate the indicated pilot flame 46 within the combustion chamber 24, the pilot flame 46 being used to ignite the main burner 26 when the gas valve and control 32 supplies gas to it the next time the main burner needs to be fired.

In many conventional standing pilot systems, most of the heat from the standing pilot flame 46 simply goes up the flue 28 without adding appreciable heat to the tank water 22. However, in the standing pilot burner system 10 of the present invention, this waste of standby pilot flame heat is reduced by the provision within the combustion chamber 24 of a heat concentrating structure representatively in the form of a generally vertically oriented tube member 48 having an open upper end 50 positioned downwardly adjacent the bottom head 16, and a downwardly and horizontally outwardly flared open lower end 52 disposed above the standing pilot flame 46.

Representatively, but not by way of limitation, the upper end 50 of the tube member 48 is downwardly offset from the tank bottom wall 16 by a distance D of about 0.5 inches, and the flare angle of the lower tube end is approximately 10 degrees. The length and diameter of the non-flared upper body portion of the tube member 48 may be varied as necessary to suit the configuration of the combustion chamber 24 and the vertical location of the pilot burner 42.

During standby periods of the water heater 12, substantially all of the heat of the pilot flame 46 is funneled upwardly through the tube 48 and, as indicated by the arrow 54, is transferred to and concentrated on the bottom surface of an overlying portion 16*a* of the bottom head 16 instead of simply flowing upwardly through the flue 28 and essentially being wasted. In this manner, the heat of the standing pilot flame 46 is more efficiently transferred to the tank water 22 through the bottom head 16, thereby better utilizing the energy available from the pilot flame 46. Depending on the design parameters of the water heater 12, the firing rate of the pilot burner 42 may be appropriately selected so that the heat its flame 46 transfers to the bottom head 16 during standby periods is insufficient to cause overheating of the tank water 22.

Figure 2:
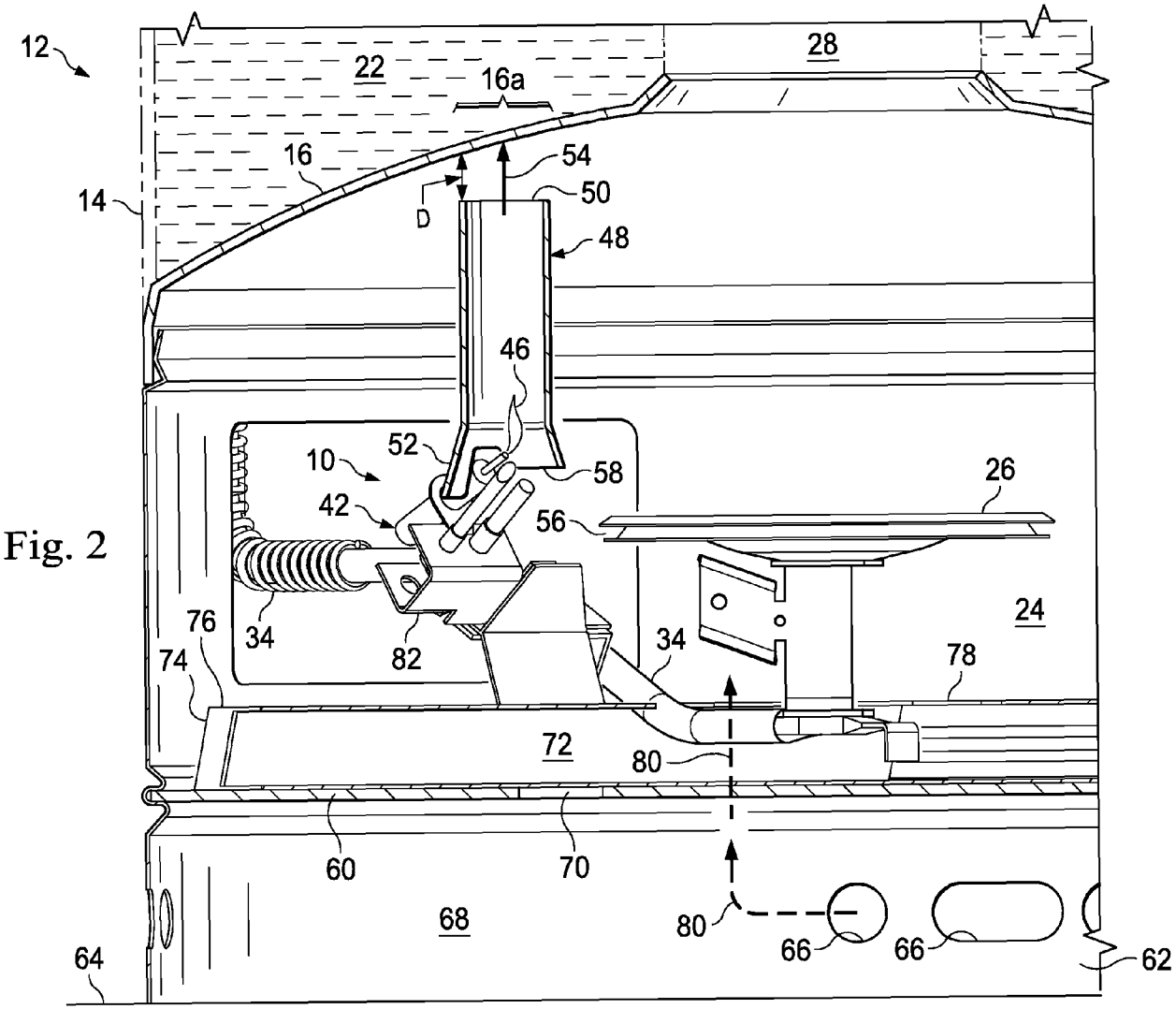
FIG. 2 is an enlarged scale, somewhat more detailed horizontally directed cross-sectional view through a lower portion of the water heater, with portions thereof having been removed for illustrative clarity.
Figure 3:
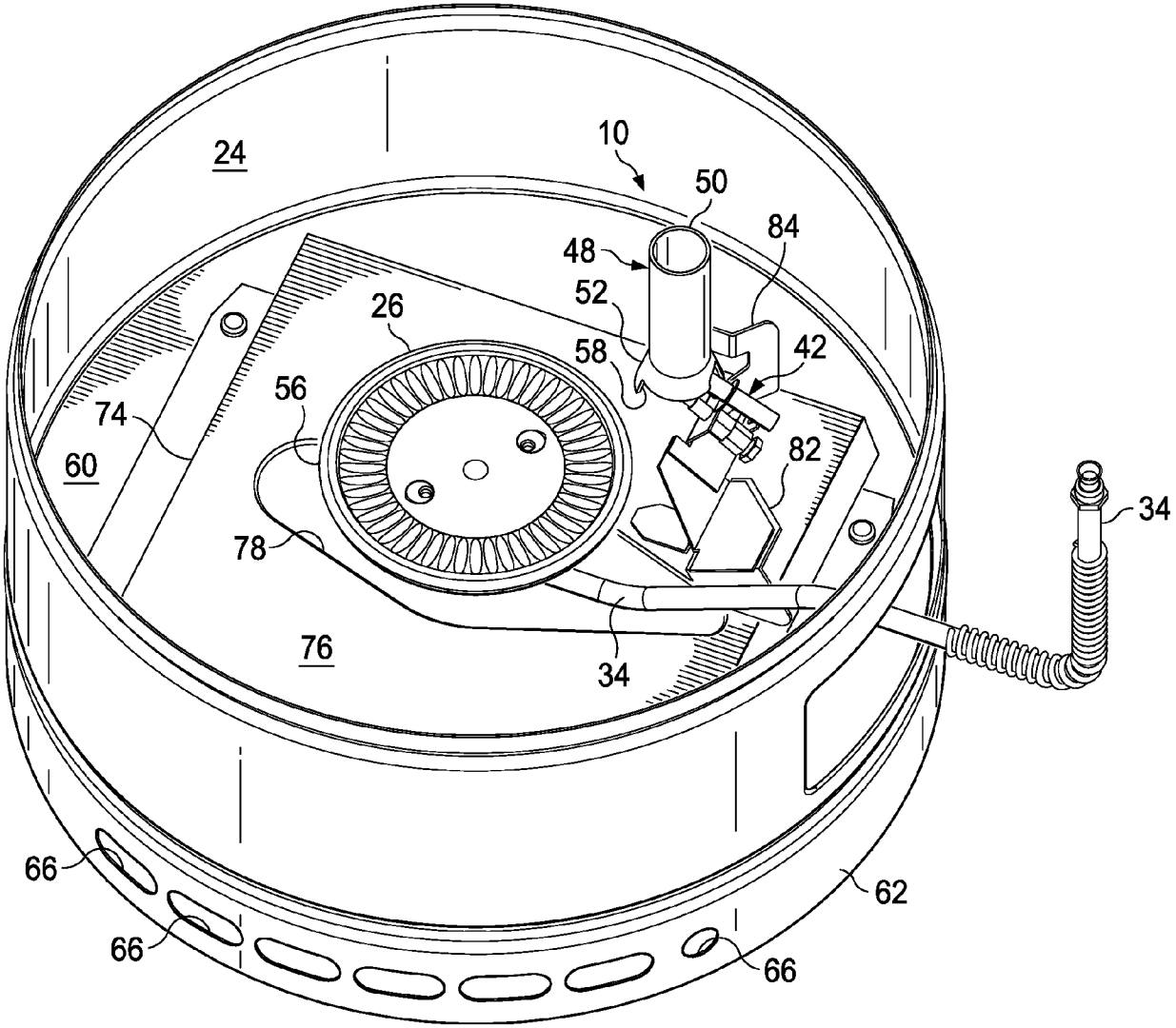
FIG. 3 is a downwardly directed perspective view of the combustion chamber portion of the water heater, with portions thereof having been removed for illustrative clarity.
Figure 4:
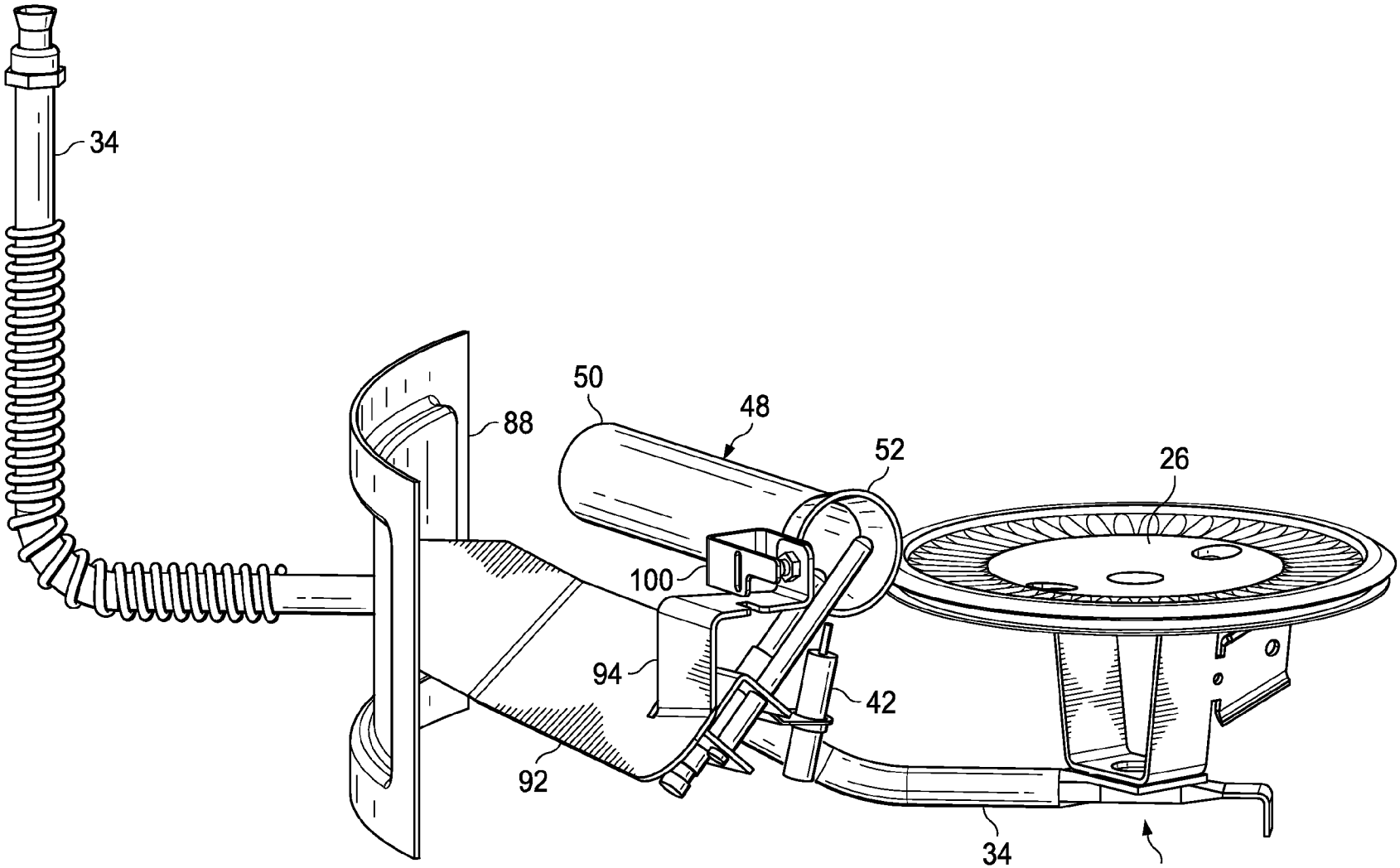
FIG. 4 is a perspective view of a specially designed burner assembly, removed from the water heater combustion chamber, with a heat concentration tube portion of the burner assembly being downwardly pivoted to an installation position thereof.

As best illustrated in FIGS. 2 and 3, the main burner 26 representatively has a generally circular upper body with an annular, horizontally outwardly facing side edge portion 56. Preferably, a side wall cutout area 58 is formed in the flared lower end portion 52 of the tube 48 and extends upwardly from its bottom end edge. Side wall cutout area 58, as shown, faces the main burner side edge portion 56 and is in a horizontally adjacent, outwardly spaced relationship therewith. The provision of this side wall cutout area in the lower tube end facilitates pilot flame lighting of the main burner 26 by making it easier for gas issuing from the main burner 26 during lighting thereof to reach the pilot flame 46 within the lower tube end and be ignited.

Extending downwardly from a bottom wall 60 of the combustion chamber 24 is a circular skirt wall 62 that rests on a horizontal support surface, such as the illustrated floor 64. A circumferentially spaced series of combustion air inlet openings 66 extend through the skirt wall 62 into an air inlet plenum 68 that it horizontally bounds. An air transfer opening 70 formed in the bottom combustion chamber wall 60 communicates the plenum 68 with the interior 72 of a raised platform structure 74 disposed within the combustion chamber 24 and extending upwardly from the bottom combustion chamber wall 60 beneath the main burner 26. Platform structure 74 has a top side wall 76 disposed directly beneath the main burner 26 and having a generally diamond-shaped air supply opening 78 formed therein.

During firing of the water heater 12 (as well as during standby periods in which only the pilot burner 42 is being operated), combustion air 80 from outside the water heater 12 sequentially flows inwardly through the skirt air openings 66 into the plenum 68, and then upwardly through the openings 70 and 78 into the combustion chamber 24 for delivery to the burners 26,42.

Representatively, the pilot burner 42 is operatively supported within the combustion chamber 24 by a bracket 82 secured to the main burner gas supply line 34, and the tube 48 is operatively supported within the combustion chamber 24 by a bracket 84 secured to the top side wall 76 of the platform structure 74. However, as will be readily appreciated by those of skill in this particular art, a variety of alternative supporting structures could be employed if desired to operatively secure these components within the combustion chamber 24.

As previously described, the tube member 48 functions as a heat concentrating structure for receiving pilot flame heat and concentrating it on a bottom surface of a portion 16*a* of the bottom head or wall 16 of the tank 14. Tube member 48 additionally helps to stabilize the pilot flame 46 and shield it from condensate which may drip from the underside of the bottom tank wall 16. While the heat concentrating structure has been illustratively depicted as having a tubular configuration, it will be readily appreciated by those of skill in this particular art that it could have a different configuration, if desired, without departing from principles of the present invention. Moreover, while the present invention has been representatively illustrated and described herein as being utilized in conjunction with a fuel-fired water heater, it will readily be appreciated by those of skill in this particular art that it could alternatively be utilized in conjunction with other types of fuel-fired heating apparatus without departing from principles of the present invention.

With reference now to FIGS. 4-8, which illustrate an alternate embodiment of the previously described water heater apparatus, it can be seen that the heat concentrating tube 48 forms a portion of an overall burner assembly 86 that is secured to and supported on an illustrated inner end portion of the main burner gas supply line 34, the burner assembly 86 including the main burner 26, the pilot burner 42, the heat concentrating tube 48, and an inner door member 88 configured to be secured to and outwardly cover a combustion chamber side wall opening 90. To operatively install the burner assembly 86 within the combustion chamber 24, the burner assembly 86 on the main burner gas supply line portion 34 is inserted inwardly through the side wall opening 90 until the door member 88 outwardly abuts the combustion chamber side wall, at which point the door member 88 is sealingly secured to the combustion chamber side wall over the opening 90, thereby operatively supporting the burner assembly 86 on the main burner gas supply line portion within the combustion chamber 24.

Figure 5:
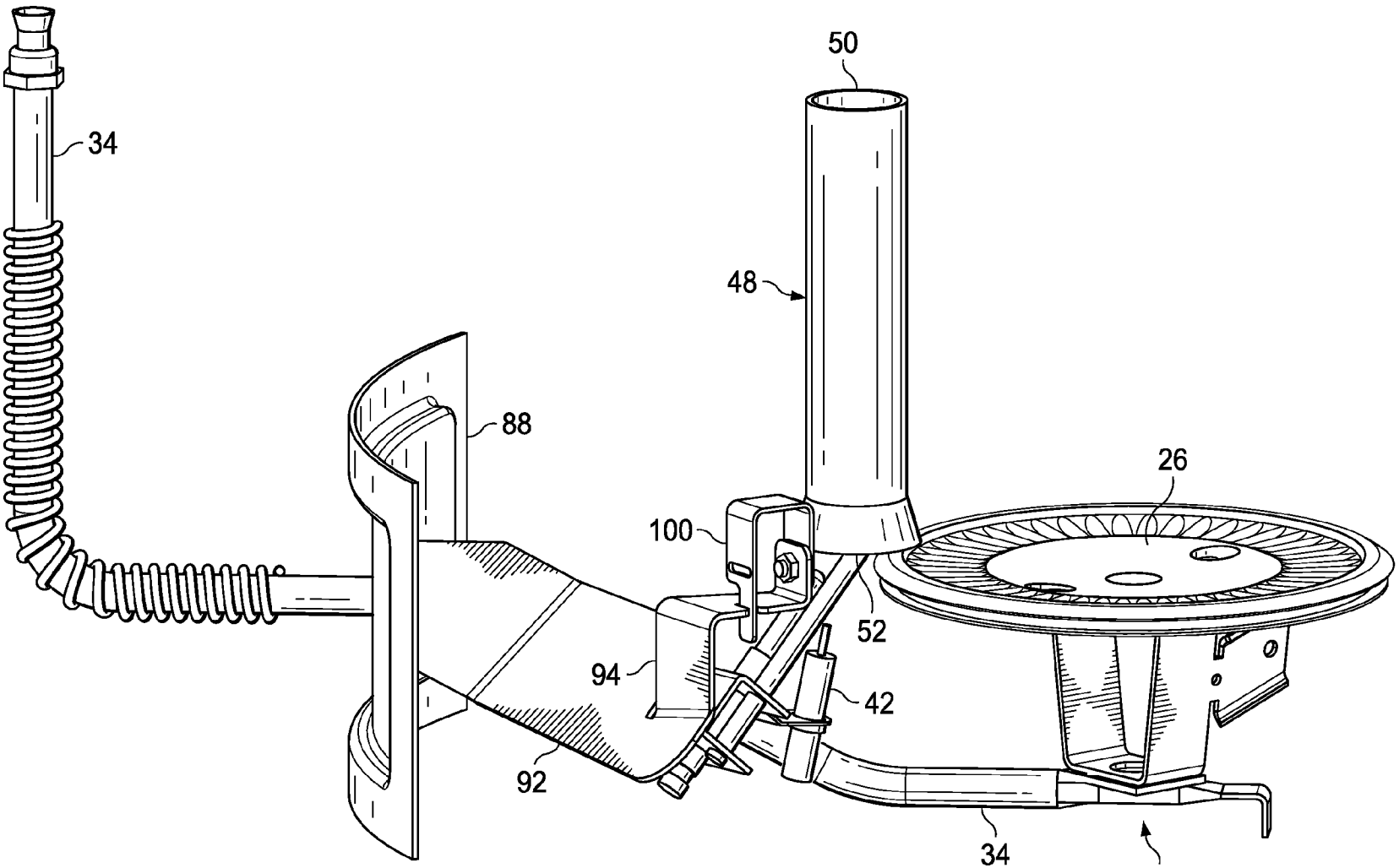
FIG. 5 is a perspective view of the burner assembly with the heat concentration tube being pivoted upwardly to its operation position.

In order to facilitate the inward installation insertion of the burner assembly 86 through the combustion chamber side wall opening 90, the heat concentrating tube 48 may be mounted on the main burner gas supply line 34, in a subsequently described manner, for pivotal movement relative thereto between a downwardly pivoted horizontal installation position (see FIGS. 4 and 6) and an upwardly pivoted vertical operating position (see FIGS. 5 and 7).

In the alternate burner assembly embodiment 86 shown in FIGS. 4-8, the heat concentrating tube 48 and the pilot burner 42 are supported on a bracket 92 secured to the main burner gas supply line portion 34 just inwardly of the inner door member 88. As may be best seen in FIG. 8, the bracket 92 has an upstanding inner end portion 94 having a side edge slot 96 into which a side edge detent projection 98 extends. A generally inverted U-shaped bracket 100 has an upper end wall 102 and opposite, spaced apart side walls 104,106 extending transversely from the upper end wall 102. Side wall 104 of bracket 100 is secured to an upstanding outer end section 108 of bracket portion 94 by a bolt 110 that permits the bracket 100 to pivot relative to the bracket portion 94 about the axis of the bolt 110. An inlet end portion of the heat concentrating tube 48 is fixedly anchored to the bracket side wall 104 so that the tube 48 may pivot with the bracket 100, about the axis of the bolt 110, between the FIG. 6 horizontal installation position of the tube 48 and the FIG. 7 generally vertical operating position of the tube 48.

Figure 6:
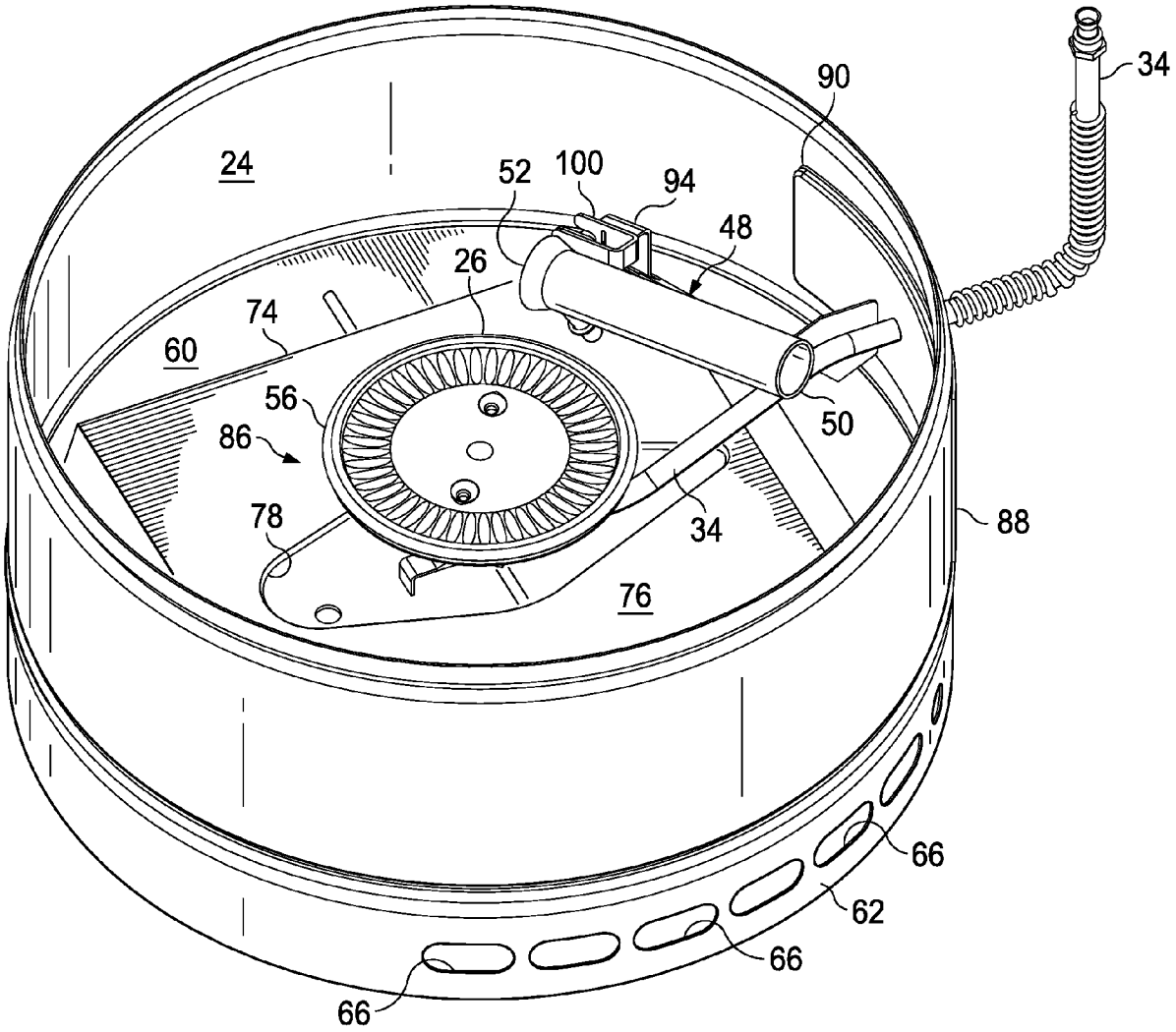
FIG. 6 is a downwardly directed perspective view of the water heater combustion chamber with the burner assembly being initially inserted thereinto with the heat concentration tube in its downwardly pivoted installation position.
Figure 7:
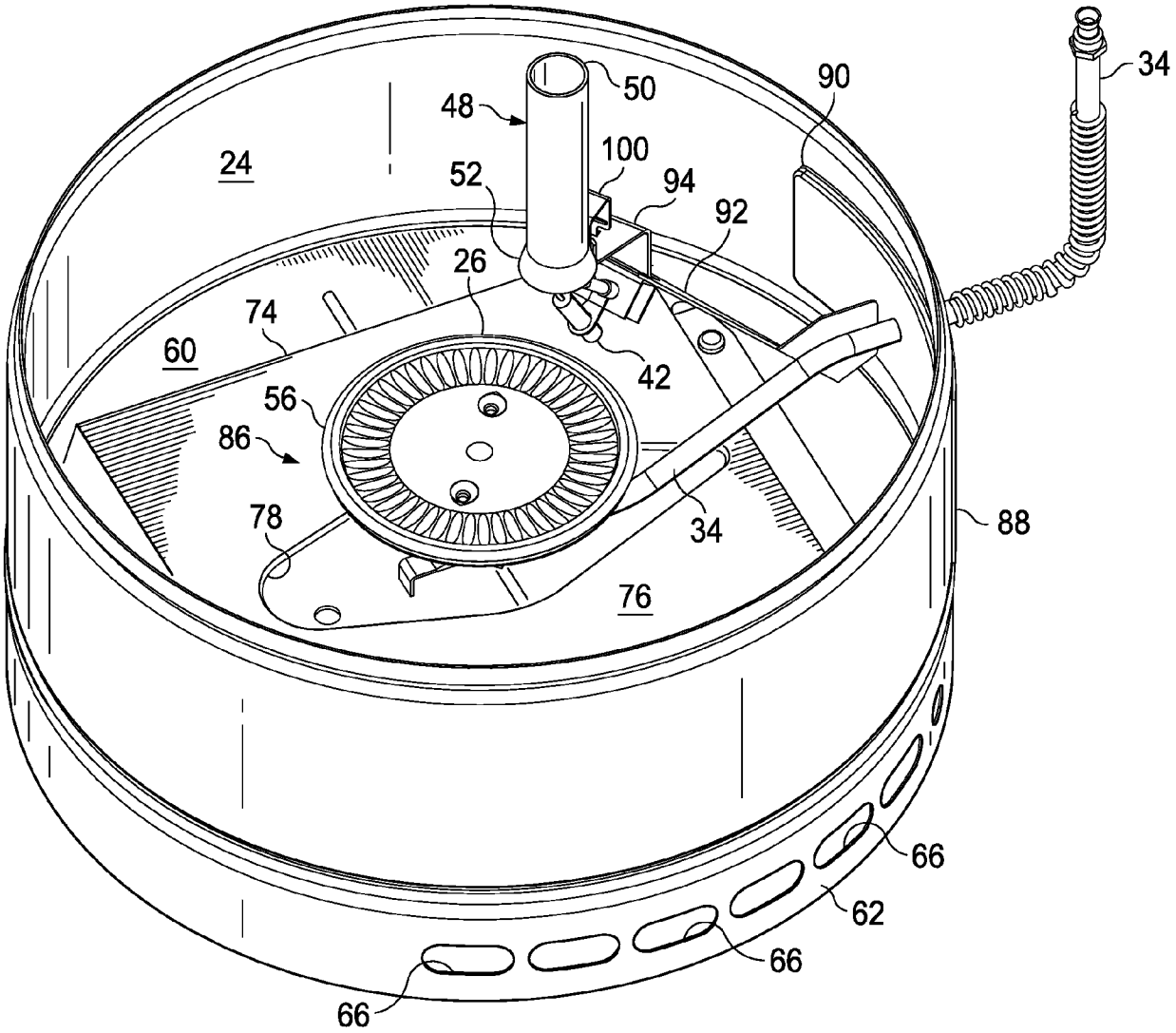
FIG. 7 is a view similar to FIG. 6, but with the heat concentration tube being upwardly pivoted to its operation position.

As can be seen in FIGS. 6 and 7, the combustion chamber side wall opening 90 is circumferentially elongated, and has a height substantially shorter than the length of the heat concentrating tube 48. However, the horizontal length of the combustion chamber side wall opening 90 is somewhat greater than the length of the tube 48. Accordingly, with the tube 48 in its horizontal installation orientation (see FIG. 6) the entire burner assembly 86 on the main burner gas supply line 34 may be passed inwardly through the combustion chamber side wall opening 90, and the inner door member 88 secured to the combustion chamber side wall over its opening 90 to support the burner assembly 86 within the combustion chamber 24. After this is done, the heat concentrating tube 48 is simply pivoted upwardly from its FIG. 6 horizontal installation position to its FIG. 7 generally vertical operating position within the combustion chamber 24.

Figure 8:
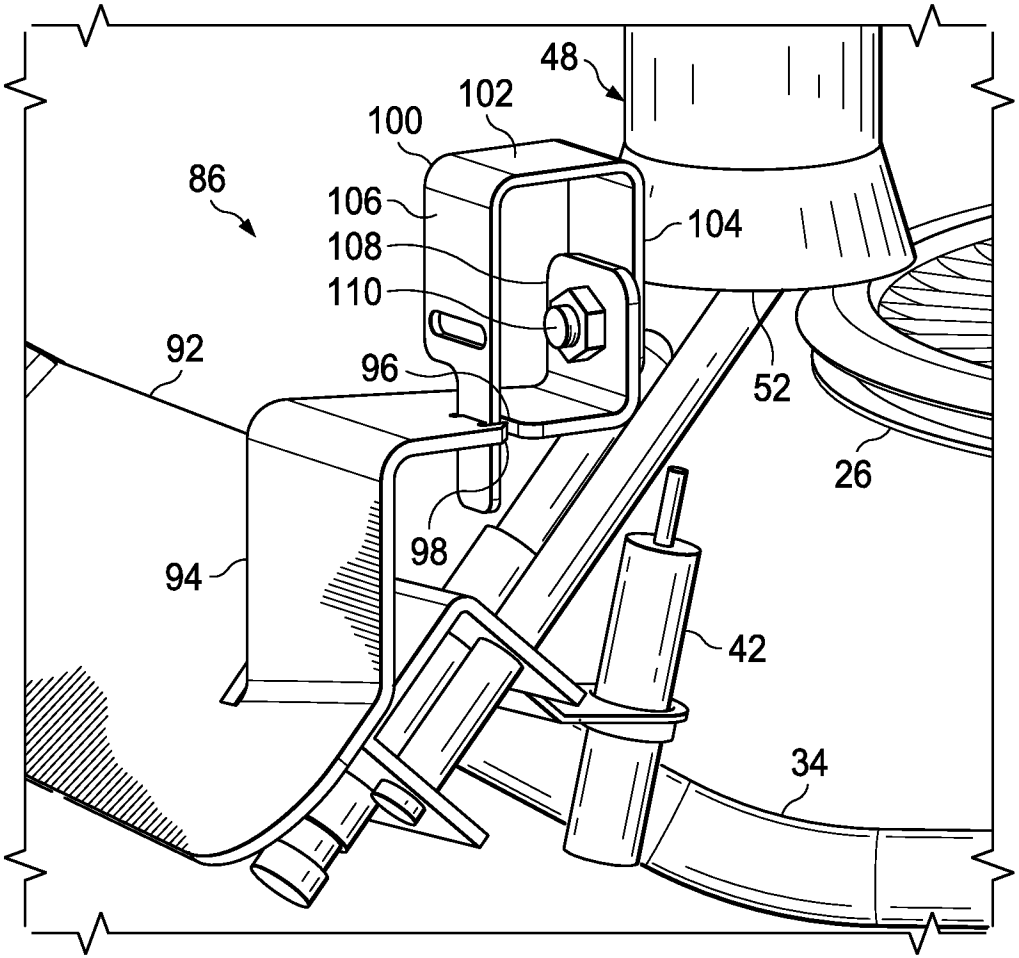
FIG. 8 is an enlarged scale perspective detail view of the burner assembly illustrating the manner in which the heat concentration tube may be releasably locked in its operation position.

As illustrated in FIG. 8, in response to such upward pivoting of the tube 48, a lower end portion of the bracket wall 106 is resiliently deflected into the bracket slot 96 by the bracket projection 98, and then snaps back into the slot 96 along the inner side edge of the projection 98 which blocks downward pivoting of the bracket 100, thereby releasably retaining the tube 48 in its generally vertical operating position within the combustion chamber 24. Bracket 100 thus cooperates with bracket portion 94 to form a detent structure that releasably locks the tube 48 in its generally vertical operating position within the combustion chamber 24.

According to a further aspect of the present invention, which may be utilized with or in place of the previously described heat concentrating structure, the standing pilot burner 42 is of a dual input type having a low firing rate and a high firing rate depending on the degree of opening of the previously mentioned pilot gas valve 44*a* (see FIG. 1) as appropriately governed by the gas valve and control 32 (or a separate control if desired). Schematically depicted in FIGS. 9-12 are four representative modes of controlling the dual input standing pilot burner 42 to increase the efficiency of the water heater 12.

Figure 9:
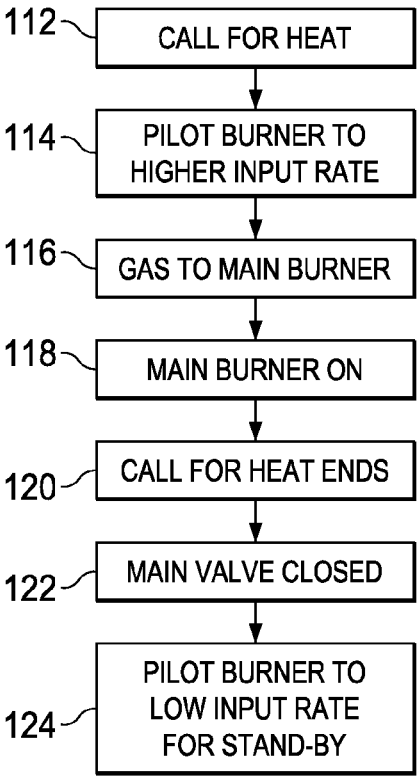
FIGS. 9-12 are logic flow charts functionally depicting methods of controlling a dual input standing pilot burner portion of the water heater, in accordance with principles of the present invention, to increase the operating efficiency of the water heater.

Utilizing the control algorithm of the first operating mode, shown in FIG. 9, in response to a call for heat at step 112 during a standby period of the water heater 12, the pilot fuel burner 42 is sequentially set to its high input rate at step 114; gas is supplied to the main burner 26 at step 116; and the main burner 26 is ignited at step 118. In response to the heat call ending at step 120, the main valve 26 is closed at step 122, thereby initiating a subsequent standby period of the water heater 12, and at step 124 the pilot fuel burner 42 is set to its low firing rate at the onset of the standby period. In the first representative operating mode of the control algorithm depicted in FIG. 9, the pilot fuel burner 42 is maintained at its low firing rate during the entire standby period.

Figure 10:
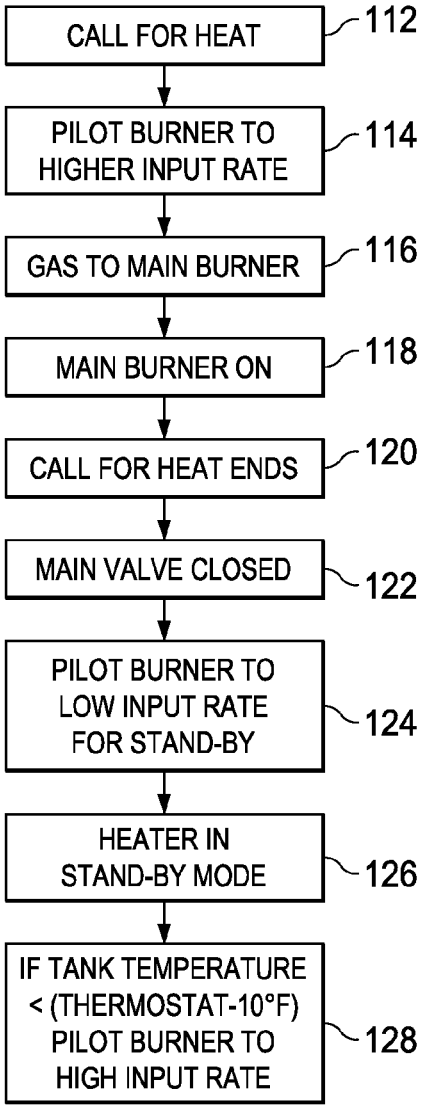
Figure 11:
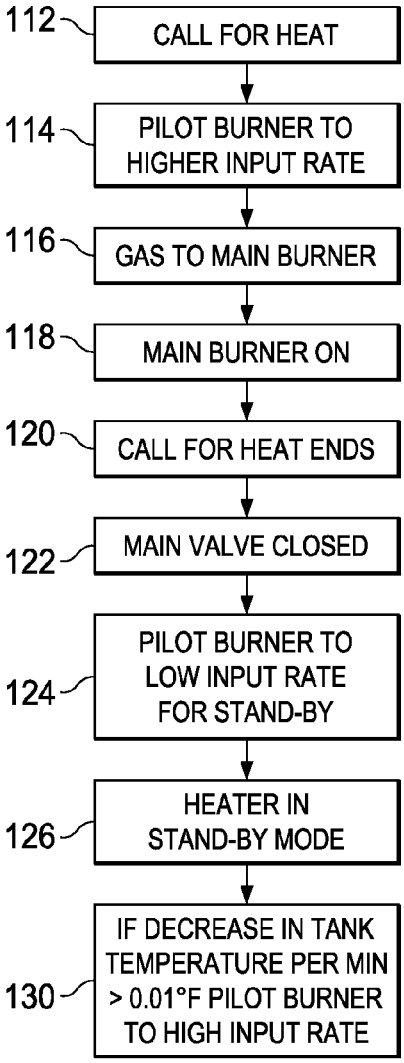
Figure 12:
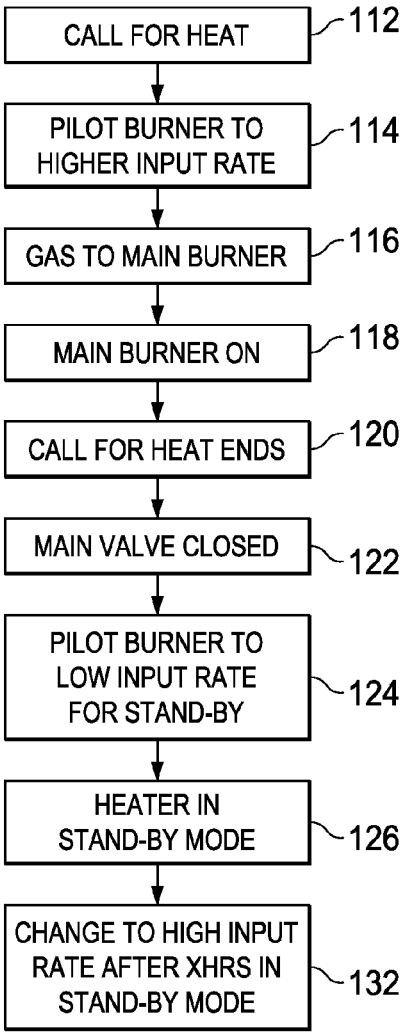

Steps 112-124 in the second through fourth representative operating modes of the control algorithm depicted in FIGS. 10-12 the steps 112-124 are identical to the previously described steps 112-124 in FIG. 9, and in the identical steps 126 in the second through fourth modes shown in FIGS.

10-12 the water heater is in a standby mode thereof following the setting of the pilot burner 42 to its low firing rate. As described below, in the second through fourth control algorithm modes shown in FIGS. 10-12 the pilot fuel burner 42 is conditionally held at its low firing rate during a standby period of the water heater 12.

Specifically, in step 128 of the second representative control algorithm mode shown in FIG. 10 the pilot fuel burner 42 is reset to its high firing rate from its low firing rate during the standby period if the controller-sensed water heater tank water temperature is less than the set point temperature of the water heater minus a predetermined number of degrees, representatively ten degrees Fahrenheit. In step 130 of the third representative control algorithm mode shown in FIG. 11 the pilot fuel burner 42 is reset to its high firing rate from its low firing rate during the standby period if a controller-sensed decrease in tank water temperature per minute is greater than a predetermined rate, (representatively 0.01 degrees Fahrenheit per minute). In step 132 of the fourth representative control algorithm mode shown in FIG. 12 the pilot fuel burner 42 is reset to its high firing rate from its low firing rate during the standby period if the water heater 12 has been in the standby mode for a predetermined length of time.

The foregoing detailed description is to be clearly understood as being given by way of illustration and example only, the spirit and scope of the present invention being limited solely by the appended claims.

What is claimed is:

1. Fuel-fired liquid heating apparatus comprising:

a tank for holding a quantity of liquid to be heated, said tank having a bottom wall;

a combustion chamber disposed beneath and upwardly bounded by said bottom wall;

a flue communicating with said combustion chamber and extending upwardly from said bottom wall through the interior of said tank;

a main fuel burner; and fuel-fired combustion apparatus operative to create hot combustion products which flow upwardly through said flue and transfer heat therethrough to liquid stored in said tank, said fuel-fired combustion apparatus comprising a pilot burner system having:

a pilot fuel burner operative to create within said combustion chamber, during standby periods of said fuel-fired liquid heating apparatus, a standing pilot flame underlying a bottom surface portion of said bottom wall, and a heat concentrating structure interposed between said pilot fuel burner and said bottom surface portion of said bottom wall and having a generally vertical, open-ended passage extending therethrough and being operative to upwardly receive said standing pilot flame and concentrate its heat on said bottom surface portion of said bottom wall of said tank, wherein said heat concentrating structure comprises a generally vertically oriented tube member, having an open lower end portion and an open upper end portion, wherein the lower end portion of said generally vertically oriented tube member is positioned to receive said standing pilot flame, and wherein said lower end portion of said tube member has a lower end edge and a side wall cutout area generally facing the main fuel burner extending upwardly through said lower end edge, the side wall cutout area being arranged to allow airflow from the pilot burner to the main fuel burner for igniting the main fuel burner by means of the pilot burner.

2. The fuel-fired liquid heating apparatus of claim 1 wherein:

said fuel-fired liquid heating apparatus is a fuel-fired water heater.

3. The fuel-fired liquid heating apparatus of claim 1 wherein:

said fuel-fired liquid heating apparatus is a gas-fired water heater.

4. The fuel-fired liquid heating apparatus of claim 1 wherein: said lower end portion of said generally vertically oriented tube member has a downwardly and horizontally outwardly flared lower end portion positioned to receive said standing pilot flame.

5. The fuel-fired liquid heating apparatus of claim 1 wherein: the main fuel burner is disposed in said combustion chamber and has a side periphery, and said side wall cutout area is in a generally, horizontally adjacent relationship with said side periphery of said main fuel burner.

6. The fuel-fired liquid heating apparatus of claim 4 wherein:

said flared lower end portion is flared downwardly and horizontally outwardly at angle of approximately ten degrees.

7. The fuel-fired liquid heating apparatus of claim 1 wherein: said open upper end portion is spaced downwardly apart from said bottom surface portion of said bottom wall by a distance of about 0.5 inches.

8. The fuel-fired liquid heating apparatus of claim 1 wherein:

said fuel-fired liquid heating apparatus further comprises a fuel supply line, said combustion chamber has a side wall opening, and said heat concentrating structure and said pilot fuel burner are supported on said fuel supply line for insertion therewith into said combustion chamber through said side wall opening thereof, said heat concentration structure being pivotable relative to said fuel supply line between an installation position in which said passage is generally horizontally oriented to facilitate inward movement of said heat concentration structure through said combustion chamber side wall opening, and an operating position in which said passage is generally vertically oriented.

9. The fuel-fired liquid heating apparatus of claim 8 wherein:

said fuel-fired liquid heating apparatus further comprises a detent structure for releasably locking said heat concentration structure in said operating position thereof.

10. The fuel-fired liquid heating apparatus of claim 1 wherein:

said pilot fuel burner is a dual input burner having high and low firing rates, and said fuel-fired liquid heating apparatus further comprises:

a main fuel burner, and a controller operative, in response to a call for heat, to set said pilot fuel burner to its high fire rate, and supply fuel to and ignite said main fuel burner, said controller further being operative, in response to said heat demand being satisfied, to terminate operation of said main fuel burner, thereby initiating a subsequent standby period of said fuel-fired liquid heating apparatus, and set said pilot fuel burner to its low firing rate at the onset of said subsequent standby period.

11. The fuel-fired liquid heating apparatus of claim 10 wherein:

said controller is further operative to maintain said pilot fuel burner at its low firing rate for the entire duration of said subsequent standby period.

12. The fuel-fired liquid heating apparatus of claim 10 wherein:

said controller is further operative to reset said pilot fuel burner to its high firing rate during said subsequent standby period if the temperature of liquid in said tank falls to a level less than a set point temperature minus a predetermined number of degrees.

13. The fuel-fired liquid heating apparatus of claim 10 wherein:

said controller is further operative to reset said pilot fuel burner to its high firing rate during said subsequent standby period in response to a rate of decrease in the temperature of liquid in said tank being greater than a predetermined rate.

14. The fuel-fired liquid heating apparatus of claim 10 wherein:

said controller is further operative to reset said pilot fuel burner to its high firing rate during said subsequent standby period if said water heater remains in said subsequent standby mode for a predetermined length of time.

15. A fuel-fired water heater comprising:

a tank for holding a quantity of water to be heated, said tank having a bottom wall;

a combustion chamber disposed beneath and upwardly bounded by said bottom wall;

a flue communicating with said combustion chamber via an open lower end of said flue, and extending upwardly from said bottom wall through the interior of said tank; and fuel-fired combustion apparatus operative to create hot combustion products which flow upwardly through said flue and transfer heat therethrough to water stored in said tank, said fuel-fired combustion apparatus comprising:

a main fuel burner disposed in said combustion chamber in an underlying relationship with said open lower end of said flue, a pilot fuel burner disposed in said combustion chamber in a horizontally offset relationship with said main fuel burner and said open lower end of said flue, said pilot fuel burner being operative to create within said combustion chamber, during standby periods of said water heater, a standing pilot flame disposed beneath a bottom surface portion of said bottom wall, and a generally vertically oriented tube member, having an open lower end portion and an open upper end portion, disposed in said combustion chamber and interposed between said pilot fuel burner and said bottom surface portion of said bottom wall in a downwardly spaced relationship with said bottom surface portion, said tube member being operative to upwardly receive said standing pilot flame and concentrate its heat on said bottom surface portion of said bottom wall of said tank, wherein the lower end portion of said tube member is positioned to receive said standing pilot flame, wherein said lower end portion of said tube member has a lower end edge and a side wall cutout area generally facing the main fuel burner extending upwardly through said lower end edge, the side wall cutout area being arranged to allow airflow from the pilot burner to the main fuel burner for igniting the main fuel burner by means of the pilot burner.

16. The fuel-fired water heater of claim 15 wherein:

said water heater is a gas-fired water heater.

17. The fuel-fired water heater of claim 15 wherein: said lower end portion of said tube member has a downwardly and horizontally outwardly flared lower end portion positioned to receive said standing pilot flame.

18. The fuel-fired water heater of claim 15 wherein:

said main fuel burner has a side periphery, and said side wall cutout area is in a generally, horizontally adjacent relationship with said side periphery of said main fuel burner.

19. The fuel-fired water heater of claim 15 wherein: said upper end portion is spaced downwardly apart from said bottom surface portion of said bottom wall by a distance of about 0.5 inches.

20. The fuel-fired water heater of claim 15 wherein:

said fuel-fired water heater further comprises a fuel supply line, said combustion chamber has a side wall opening, and said main fuel burner, said pilot fuel burner and said tube member are supported on said fuel supply line for insertion therewith into said combustion chamber through said side wall opening thereof, said tube member being pivotable relative to said fuel supply line between an installation position in which said tube member is generally horizontally oriented to facilitate inward movement of said tube member through said combustion chamber side wall opening, and an operating position in which said tube member is generally vertically oriented.

21. The fuel-fired water heater of claim 20 wherein:

said fuel-fired water heater further comprises a detent structure for releasably locking said tube member in said operating position thereof.

22. The fuel-fired water heater of claim 15 wherein:

said pilot fuel burner is a dual input burner having high and low firing rates, and said fuel-fired water heater further comprises:

a controller operative, in response to a call for heat, to set said pilot fuel burner to its high fire rate, and supply fuel to and ignite said main fuel burner, said controller further being operative, in response to said heat demand being satisfied, to terminate operation of said main fuel burner, thereby initiating a subsequent standby period of said fuel-fired water heater, and set said pilot fuel burner to its low firing rate at the onset of said subsequent standby period.

23. The fuel-fired water heater of claim 22 wherein:

said controller is further operative to maintain said pilot fuel burner at its low firing rate for the entire duration of said subsequent standby period.

24. The fuel-fired water heater of claim 22 wherein:

said controller is further operative to reset said pilot burner to its high firing rate during said subsequent standby period if the temperature of liquid in said tank falls to a level less than a set point temperature minus a predetermined number of degrees.

25. The fuel-fired water heater of claim 22 wherein:

said controller is further operative to reset said pilot fuel burner to its high firing rate during said subsequent standby period in response to a rate of decrease in the temperature of liquid in said tank being greater than a predetermined rate.

26. The fuel-fired water heater of claim 22 wherein:

said controller is further operative to reset said pilot fuel burner to its high firing rate during said subsequent standby period if said water heater remains in said subsequent standby mode for a predetermined length of time.

* * * * *